US007497514B2

(12) United States Patent
Ramsey et al.

(10) Patent No.: US 7,497,514 B2
(45) Date of Patent: Mar. 3, 2009

(54) PORTABLE SPORTS BENCH

(75) Inventors: Scott D. Ramsey, Brecksville, OH (US); Emanuel Kohelis, Medina, OH (US); Aaron Marshall, Uniontown, OH (US)

(73) Assignee: Ramkoh, Inc., Brecksville, OH (US)

( * ) Notice: Subject to any disclaimer, the term of this patent is extended or adjusted under 35 U.S.C. 154(b) by 100 days.

(21) Appl. No.: 11/459,414

(22) Filed: Jul. 24, 2006

(65) Prior Publication Data

US 2007/0102976 A1 May 10, 2007

Related U.S. Application Data

(60) Provisional application No. 60/729,923, filed on Oct. 25, 2005.

(51) Int. Cl.
*A47C 4/00* (2006.01)
*A47C 15/00* (2006.01)

(52) U.S. Cl. ..... 297/234; 297/17; 297/42; 297/44

(58) Field of Classification Search ..... 297/17, 297/42, 44, 53, 54, 234, 235, 236, 121, 122, 297/125

See application file for complete search history.

(56) References Cited

U.S. PATENT DOCUMENTS 144,521 A 11/1873 Elkinton
259,953 A * 6/1882 Thudel ..... 297/11
894,344 A 7/1908 Raymond
1,558,087 A * 10/1925 Haney ..... 108/35
1,941,652 A * 1/1934 Bellavia ..... 190/12 A
2,260,478 A * 10/1941 Peter ..... 108/35
2,483,309 A * 9/1949 Amaducci ..... 297/54
2,572,732 A 10/1951 Kekien et al.
3,155,427 A 11/1964 Necessary
3,674,306 A * 7/1972 Botney ..... 297/17
3,768,860 A 10/1973 Barker
3,865,429 A 2/1975 Barker
4,191,111 A * 3/1980 Emmert ..... 108/132
4,621,865 A 11/1986 Herrera
5,154,473 A 10/1992 Joranco
5,168,889 A 12/1992 Diestel (Continued)

OTHER PUBLICATIONS

Internet http://www.athleticstuff.com/astuff/product.asp?s_id=190 &pf_id=SPORTBENCH printed Jul. 21, 2006.

*Primary Examiner*—Sarah B McPartlin
(74) *Attorney, Agent, or Firm*—Fay Sharpe LLP

(57) ABSTRACT

A portable bench includes a first seat member, a first back rest member attached to the first seat member, a second seat member attached to the first seat member, and a second back rest member attached to the second seat member. The first back rest member attaches to the first seat member such that at least one of the first seat member and the first back rest member pivots about a first axis. The second seat member attaches to the first seat member such that at least one of the first seat member and the second seat member pivots about a second axis that is at least substantially perpendicular to the first axis. The second back rest member attaches to the second seat member such that at least one of the second seat member and the second back rest member pivots about a third axis that is at least substantially parallel to the first axis.

15 Claims, 11 Drawing Sheets

U.S. PATENT DOCUMENTS 5,203,363 A 4/1993 Kidwell et al.
5,553,551 A 9/1996 Crombie
5,647,632 A * 7/1997 Fireman ..... 297/109
6,015,190 A * 1/2000 Wend ..... 297/378.1
6,296,002 B1 10/2001 Tashchyan
6,722,293 B2 * 4/2004 Lee ..... 108/118
6,789,557 B1 9/2004 Wahl, Jr.
6,854,797 B1 * 2/2005 Thomas ..... 297/16.1
2004/0056517 A1 * 3/2004 Farber et al. ..... 297/17

* cited by examiner

PORTABLE SPORTS BENCH

This application claims the benefit of U.S. provisional patent application Ser. No. 60/729,923, filed Oct. 25, 2005, which is incorporated by reference.

BACKGROUND

Many children participate in organized athletic competitions. Many of these competitions are held outdoors at large complexes that have limited seating Not only is the seating limited for spectators, e.g. parents, but the seating can also be limited for the children participating in the athletic events.

Portable seating devices are frequently used to provide seating for both the spectators and the participants of these athletic events. For example, folding chairs that are made of a flexible durable fabric material attached to a frame made of rods are typically carried to the sporting event by the parents of the participants so that the parents can sit while watching their children play. These portable chairs are designed for only one person, are not that sturdy and can be bulky to carry. These portable chairs are typically not used by the participants in the athletic event because only one child can fit on the chair and the participating children typically want to sit together as a team during the event. Furthermore, these known folding chairs typically do not provide protection from the elements, e.g., rain, sun, etc.

SUMMARY

A portable bench includes a first seat member, a first back rest member attached to the first seat member, a second seat member attached to the first seat member, and a second back rest member attached to the second seat member. The first back rest member attaches to the first seat member such that at least one of the first seat member and the first back rest member pivots about a first axis. The second seat member attaches to the first seat member such that at least one of the first seat member and the second seat member pivots about a second axis that is at least substantially perpendicular to the first axis. The second back rest member attaches to the second seat member such that at least one of the second seat member and the second back rest member pivots about a third axis that is at least substantially parallel to the first axis.

A method of collapsing a portable bench includes the following steps: folding a first seat back rest towards a first seat member; folding a second seat back rest towards a second seat member; folding a first leg towards the first seat member; folding a second leg towards the second seat member; and folding the first seat member towards the second seat member.

A method of manufacturing a portable bench includes the following steps: forming a first back rest member; forming a second back rest member; forming a first seat member; forming a second seat member; connecting the first back rest member to the first seat member such that the first back rest member pivots in relation to the first seat member; connecting the second back rest member to the second seat member such that the second back rest member pivots in relation to the second seat member; and connecting the first seat member to the second seat member such that the first seat member pivots in relation to the second seat member.

DETAILED DESCRIPTION

A portable bench 10 that overcomes the aforementioned shortcomings will be described so that one skilled in the art can make and use the bench. The bench is not limited to use only at sporting events. To the contrary, the bench can be used in any environment where portable seating is desirable.

Figure 1:
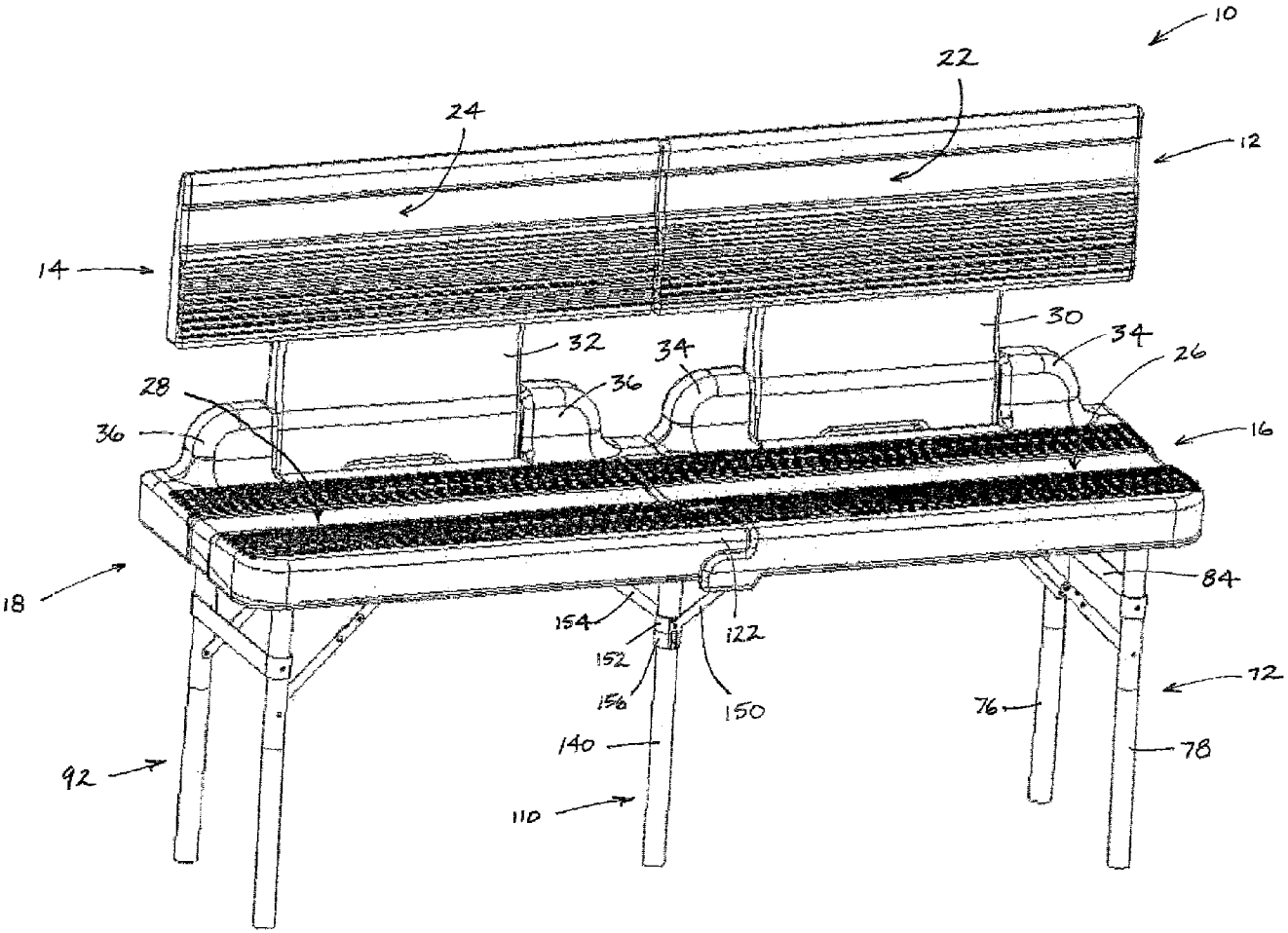
FIG. 1 is a perspective view of a portable bench.
Figure 2:
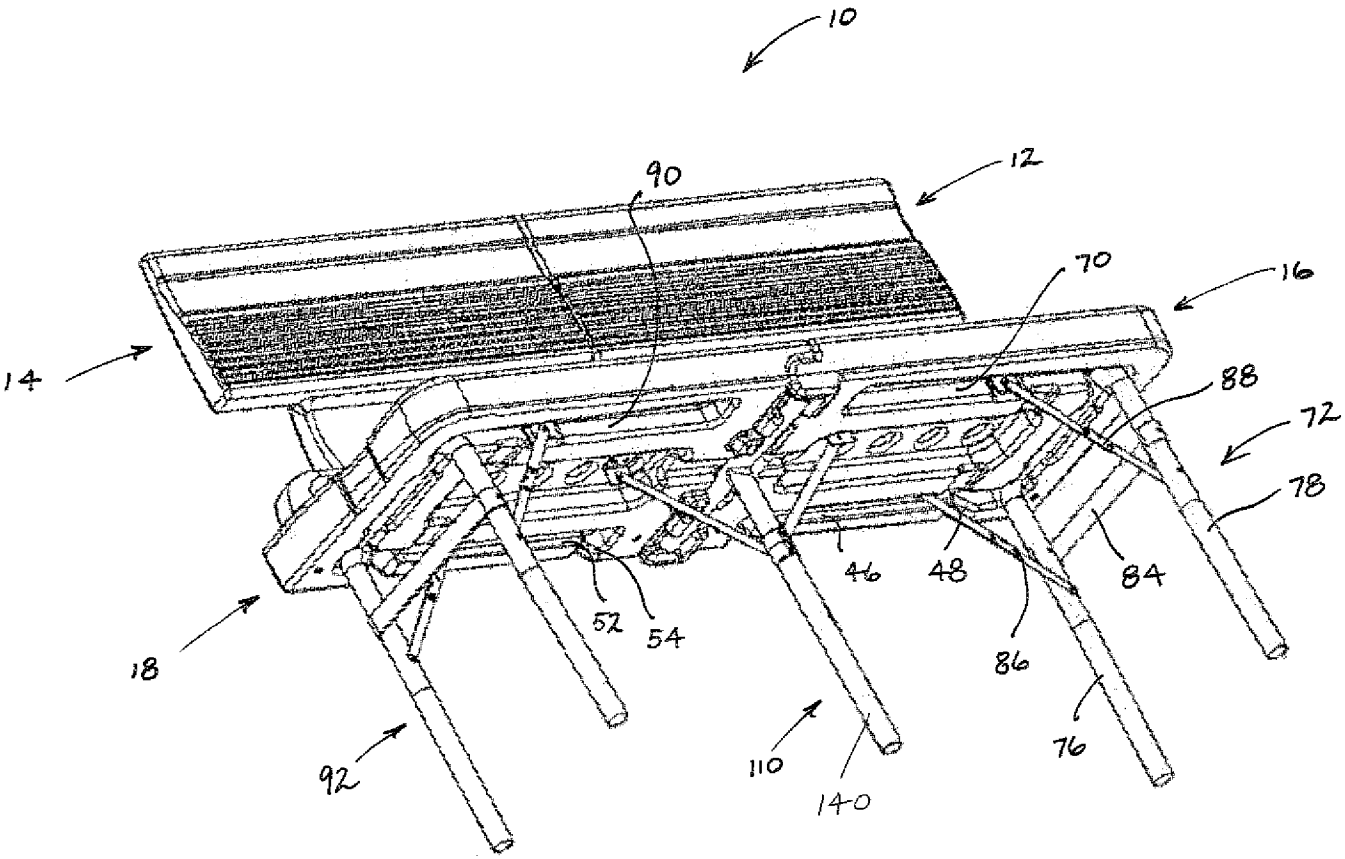
FIG. 2 is a perspective view of the underside of the portable bench of FIG. 1.
Figure 4:
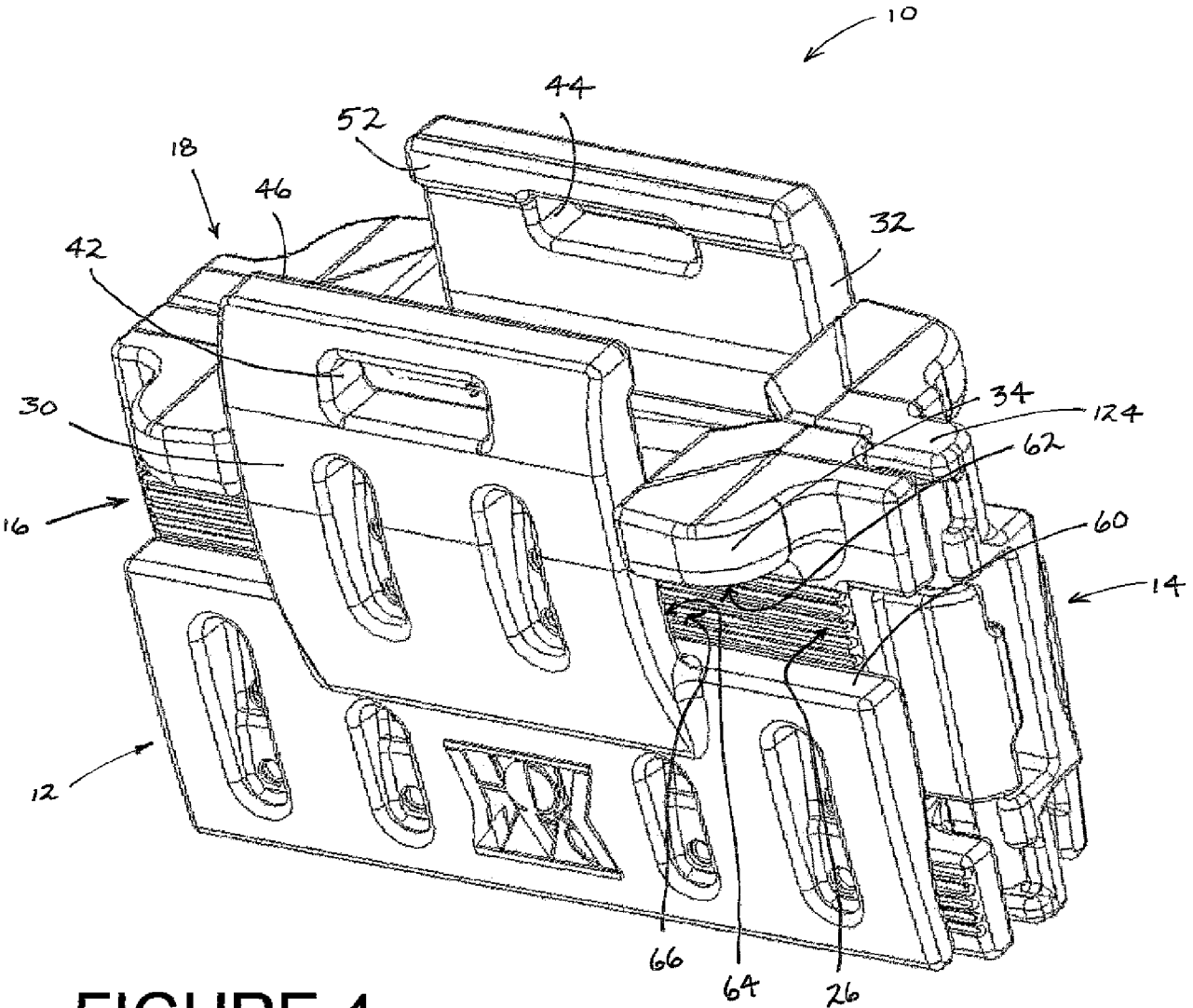
FIG. 4 is a perspective view of the portable bench of FIG. 1 being folded into a storage position.

The bench 10 generally includes at least one back rest hingedly attached to at least one seat. In the embodiment depicted in FIG. 1, a first back rest member 12 pivotally attaches to a first seat member 16 and a second back rest member 14 pivotally attaches to a second seat member 18. Alternatively, a fewer or greater number of back rests and/or seat members can be provided. The back rest members 12 and 14 can be similar in configuration; in the depicted embodiment the back rest members 12 and 14 have the same configuration, which can decrease manufacturing costs. Similarly, in the depicted embodiment the seat members 16 and 18 are similar, although not identical, in configuration. In the depicted embodiment, both the back rests 12 and 14 and the seat members 16 and 18 are made from a rigid material, for example a molded plastic, to provide a durable and lightweight portable bench 10. For ease of explanation, the sports bench will be described in a "use position," which is depicted in FIGS. 1 and 2, where the bench is ready to accommodate a person sitting on the bench and a "storage position," which is depicted in FIG. 4, where the bench is folded up, or knocked down, so that it can be easily stored and transported. Also for ease of explanation, directional terms, for example, "rear," "forward," "lower," "upper," "horizontal," "vertical," and the like will be used to describe components of the bench. These terms are not means to limit the scope of the invention, instead, these terms are used to aid in understanding the figures.

Figure 3:
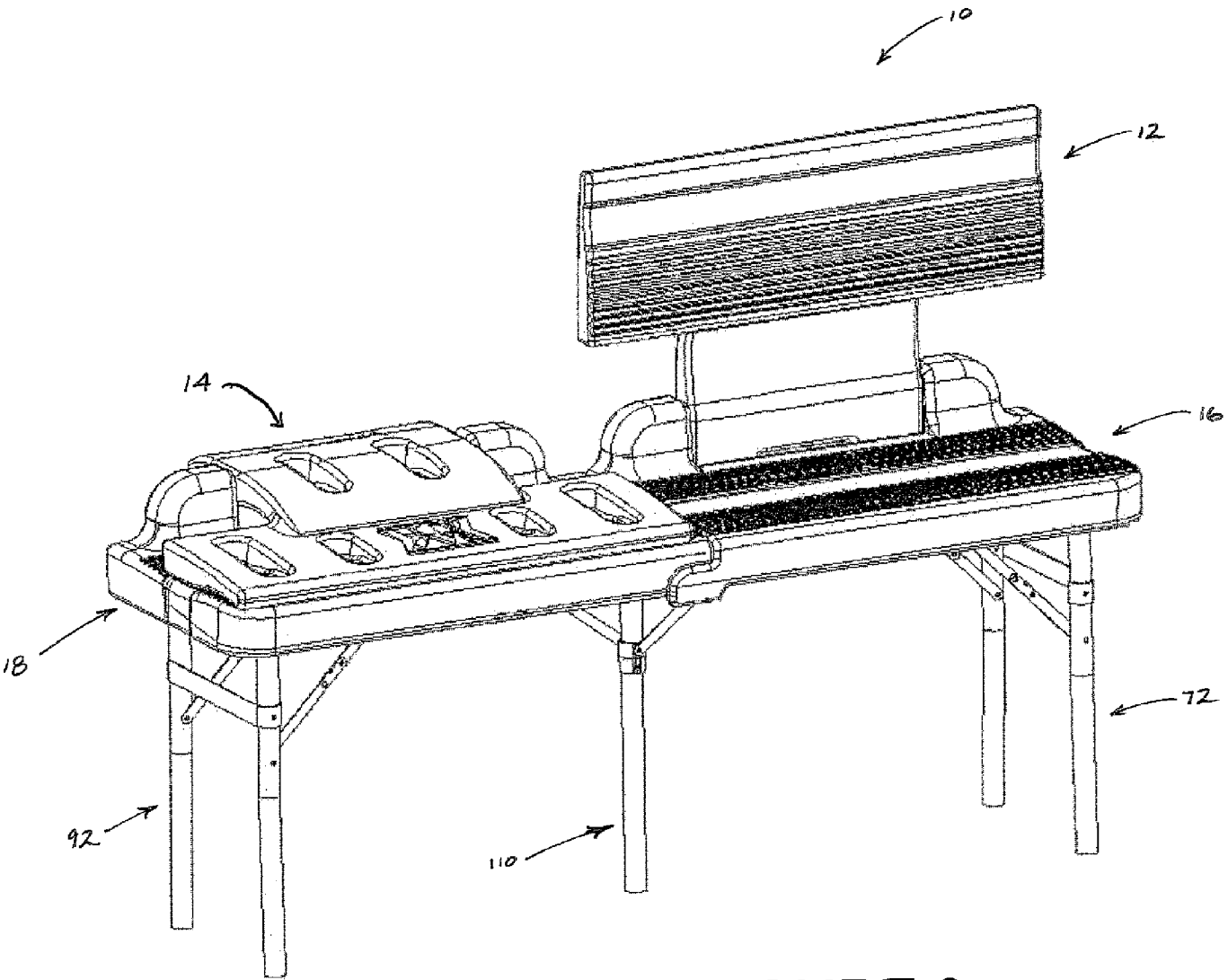
FIG. 3 is a perspective view of the portable bench of FIG. 1 showing a seat back member folded over.

Each back rest member 12 and 14 includes a respective contoured back rest surface 22 and 24, the contoured surface being the surface against which a person's back will rest when one sits on the bench. Each contoured surface is generally perpendicular to a respective upper surface 26 and 28 of a respective seat member when the bench 10 is in the use position The contoured front surface 22 of the first back rest member 12 matches the upper surface 26, which is also contoured, of the first seat member 16 so that when the first back rest member 12 is pivoted towards the first seat member 16 the contoured surfaces interfit with one another. Similarly, the contoured surface 24 of the second back rest member 14 matches the upper surface 28, which is also contoured, of the second seat member 18 so that when the second back rest member is pivoted towards the second seat member, the contoured surfaces interfit with one another, as seen in FIG. 3. If desired, the aforementioned surfaces need not be contoured.

In the depicted embodiment, a pair of back rest supports attach the respective back rest members 12 and 14 to the respective seat members 16 and 18. In the depicted embodiment, the back rest supports are integrally formed with the respective back rest members, which limits the total number of components of the bench. With reference to the depicted embodiment, the first back rest member 12 includes an integrally formed first back rest support 30 used to attach the first back rest member 12 to the first seat member 16. Likewise the second back rest member 14 includes an integrally formed second back rest support 32 that attaches the second back rest 14 to the second seat member 18. If desired the back rest supports can be made separately from the respective back rest members and attached to one another.

In the depicted embodiment, each of the back rest supports 30 and 32 has a generally curved configuration; however, the back rest supports can take other configurations. Each back rest support is also shorter in a dimension that is parallel with the axis of rotation of the respective back rest member as compared to the portion of the back rest member against which a person's back will rest when he is seated on the bench 10.

With reference to FIG. 1, the first back rest support 30 connects to a pair of upright integrally formed sections 34 that extend upwardly, i.e. towards the first back rest member 12, from a rear edge of the first seat member 16 (per the orientation of the bench 10 in the use position). Likewise, the second back rest support 32 connects to a pair of upright integrally formed sections 36 that extend upwardly, i.e. towards the second back rest member 14, from a rear edge of the second seat member 18. The connection between the respective back rest support the respective upright section is one that allows the back rest member to pivot in relation to the respective seat member. For example, each back rest support can include hubs that are received in openings or recesses in the upright sections, or vice versa. Each back rest member can snap or otherwise engage the respective seat member without the use of additional fasteners to lessen the number of components for the bench and reduce assembly time. Accordingly, if desired the portion of the bench 10 against which or upon which a person rests can be made of only four components: the two back rest members and the two seat members.

With reference to FIG. 4, which depicts the bench in the storage position handles are integrally formed in the bench 10 so that the bench can be easily carried in the depicted embodiment, the first back rest member 12 includes a generally rectangular shaped opening 42 formed near a lower end, i.e. the end nearer the first seat member 16 when the bench is in the use position, of the first back support 30. Similarly, the second back rest member 14 includes a generally rectangular shaped opening 44 formed through a lower end of the second back rest support 32. Each of the openings 42 and 44 is configured to receive a person's hand when carrying the folded bench.

With continued reference to FIG. 4, the first back rest member 12 also includes a ledge 46 formed at a lower end of the first back rest support 30. A portion of the ledge 46 is received in a ledge receiving recess 48 (FIG. 2) in a lower surface of the first seat member 16 when the first back rest member 12 is in the use position. The second back rest member 14 also includes a lower ledge 52, a portion of which is received in a ledge receiving recess 54 (FIG. 2) in a lower surface of the second seat member 18 when the second back rest member is in the use position. The ledges 46 and 52 can snap into the respective recesses 48 and 54 to lock the respective back rest members 12 and 14 in place, if desired.

With reference again to FIG. 4, a lower most edge 60 (when in the use position shown in FIG. 1) of the first back rest member 12 is spaced from a front surface 62 of the upright portion 34 when the bench 10 is in the storage position. Also, the front surface 64 (per the orientation shown in FIG. 1) of the first back rest support 30 is spaced from the upper surface 26 of the first seat member 16 when the bench 10 is in the storage position as shown in FIG. 4. Accordingly, when the first back rest member 12 is folded adjacent the first seat member 16, a space 66 is defined between the lower edge of the first back rest member, the upper surface of the first seat member, and the first curved back rest support. A similar space (not visible in FIG. 4) to the space 66 is defined between the lower edge of the second back rest member, the upper surface of the second seat member, and the second curved back rest support is provided on the opposite side of the folded bench 10. The spaces are useful to store items, such as a canopy (see FIG. 8), that can be used with the bench. The spaces can be used to store other items as well.

Figure 5:
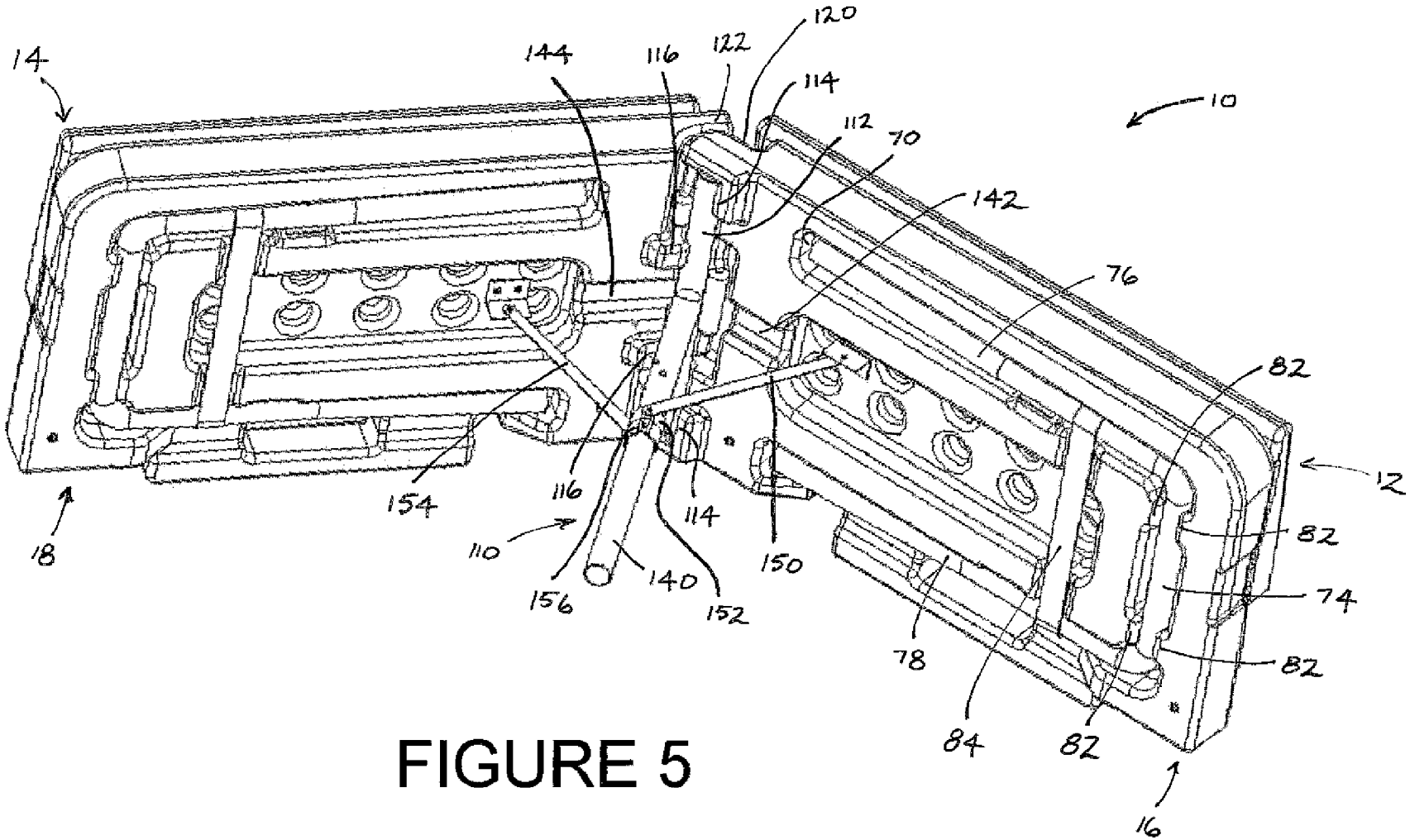
FIG. 5 is a perspective view of the underside of the portable bench of FIG. 1 showing the bench being folded toward storage position.
Figure 6:
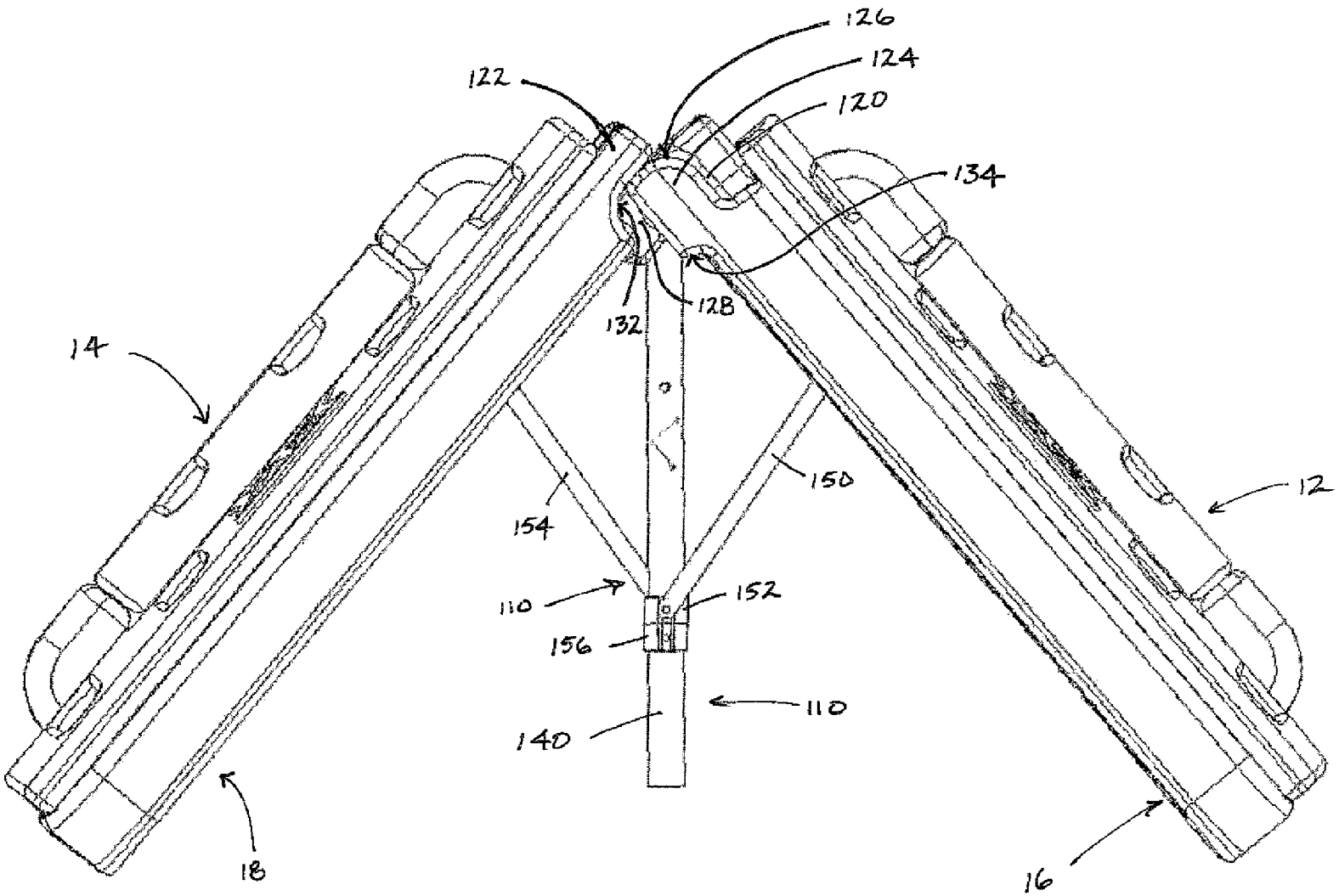
FIG. 6 is a side view of the portable bench in generally the same position as that shown in FIG. 5.

With reference to FIG. 5, the seat members 16 and 18 include cavities, or recesses, that are configured to receive legs of the bench so that the legs, when stored, are at least generally flush with a lower surface of the seat members. This allows the bench to fold up, or knock down, into a compact unit that is conveniently carried and stored.

As seen in further detail in FIG. 5, the first seat member 16 includes a recess 70 defined in a lower surface. The recess 70 is dimensioned to receive a first leg member 72 (FIG. 1) that supports the seat members. In the depicted embodiment, the recess 70 is substantially U-shaped and it receives the first leg member 72 which has a substantially U-shaped configuration. The U-shaped first leg member 72 includes a central portion 74, about which the leg member pivots, and two vertical portions 76 and 78 (per the orientation depicted in FIG. 1) that extend from the central portion. The first seat member 16 includes integrally formed tabs 82 that extend into the recess 70 to retain the central portion 74 of the leg member 72 in the recess and allow the leg member to rotate about an axis defined through the central portion. The central portion 74 of the first leg member 72 can snap between the tabs 82 into the recess 70. This connection allows for an easily assembled connection between the legs of the bench and the seat of the bench without the need for additional fasteners; however, the legs can take other configurations that may require the use of fasteners.

With reference to FIG. 1, an interconnecting support member 84 connects the first vertical portion 76 to the second vertical portion 78 to add structural integrity to the leg member 72 As more clearly seen in FIG. 2, a first hinged strut 86 attaches to the first vertical portion 76 and an underside of the first seat member 16 and a second hinged strut 88 attaches to the second vertical portion 78 and the underside of the first seat member 16 The hinged struts 86 and 88 also add to the structural integrity of the first leg member 72.

A second leg member 92, which has the same configuration as the first leg member 72 (including the additional components that attach to the first leg member), attaches to the second seat member 18. The second leg member 92 is received inside a recess 90 formed in a lower surface of the second seat member. The lower recess 90 of the second seat member 18 has a similar configuration to the recess 70 in the lower surface of the first seat member, and for the sake of brevity, will not be described with further particularity.

The leg members 72 and 92 hingedly attach near opposite respective ends of the respective seat members 16, 18 opposite where the first seat member 16 attaches to the second seat member 18. Other attachment locations for legs can be provided, for example the legs can attach near a more central location of the seat member. Alternatively, individual legs that are each hingedly attached to the respective seat member can be provided. The leg members 72 and 92 are made from an extruded aluminum or other similar durable material. As another option, foot pads (not shown in FIGS. 1-6) can be attached to the bottoms of the legs, and it may be desirable to provide four foot pads (or one foot pad per each leg portion that contact the ground) so that the portable bench 10 does not rock on an uneven surface.

The first seat member 16 attaches to the second seat member 18 so that the seat members can be folded, e.g. rotated or pivoted, about an axis that is generally parallel to the axes about which the leg members 72 and 92 rotate and perpendicular to the axes about which the back rest members 12 and 14 rotate. With reference to FIG. 2, a T-shaped member 110 provides both a hinge and a support leg for the bench. With reference to FIG. 5, a first (horizontally disposed in FIG. 2) portion 112 of the T-shaped member 110 is received between integrally formed tabs 114 in the lower surface of the first seat member 16 and integrally formed tabs 116 in the lower surface of the second seat member 18. The tabs 114 and 116 are similar in function to the tabs 82 on the under surface of the first seat member 16 in that the tabs retain the horizontal portion 112 of the T-shaped member 110 while allowing the first seat member 16 and the second seat member 18 to rotate about an axis through the horizontal portion of the T-shaped member. The tabs 114 and 116 also facilitate connection of the first seat member 16 to the second seat member 18 without requiring additional fasteners. If desired both sets of tabs on opposite sides of the horizontal portion 112 can be provided on the same seat member and connection between the seat members can be achieved similar to the manner in which the back rest members attach to the seat members.

The seat members 16 and 18 cooperate with one another so that the bench 10 folds into a compact unit that is easily stored and carried, for example as shown in FIG. 4. With reference to FIG. 5, first seat member 16 includes a keyed recess 120 that receives a keyed extension 122 of the second seat member 18 when the bench 10 is in the use position ready to accommodate a person (see FIG. 1) With reference to FIG. 6, the first seat member 16 also includes keyed extension 124 that includes a rounded end surface 126 that is received in a recess 128 formed in the second seat member 18 The recess 128 has a rounded surface 132 that complements the rounded end surface 126 of the first seat member 16 to facilitate the hinge action of the seat members. The keyed extension 124 of the first seat member 16 is received in the keyed recess of the second seat member 18 both when the seat members are folded, i.e. in the storage position, (FIG. 4, surface 134 opposite the rounded surface 126 contacts the rounded surface 132 to lock the bench in the storage position) and unfolded, i.e. in the use position, (FIG. 1). The first seat member 16 and the second seat member 18 can be pivotally attached to one another in other manners, for example by using a pin that is received through each of the seat members. In the depicted embodiment, however, the T-shaped member 1. 10 snaps between the tabs 114 and 116 (FIG. 5) to attach the seat members to one another without the need for additional fasteners.

As indicated earlier, the T-shaped member 110 also provides a support leg for the bench 10 With reference to FIG. 1 the T-shaped member 110 includes a support member 140 (vertical section per the orientation of FIG. 1) that supports the central portion of the bench 10 when the bench is in the use position. As more clearly seen in FIG. 2, the support member 140 is centrally located between the first vertical portion 76 and the second vertical portion 78 of the first leg member 72 (and the corresponding vertical portions of the second leg member 92) with respect to the rotational axes of the respective legs. In other words, when the legs 72, 92 and 110 are folded into the respective seat members, the support member 140 fits between the vertical portions of the outer legs. The first seat member 16 includes a central recess 142 and the second seat member 18 also includes a central recess 144 that each receives the support member 140 of the T-shaped member 110 when the bench 10 is in the storage position.

The T-shaped member 110 is further supported by a pair of struts. A first strut 150 pivotally attaches to the lower surface of the first seat member 16 and to a ring 152 that slides along the support member 140 (compare FIG. 2 to FIG. 5). A second strut 154 pivotally attaches to the lower surface of the second seat member 18 and to a ring 156 that slides along the support member 140. The struts 150 and 154 inhibit the support member from rotating when the bench 10 is unfolded to accommodate a person.

Figure 8:
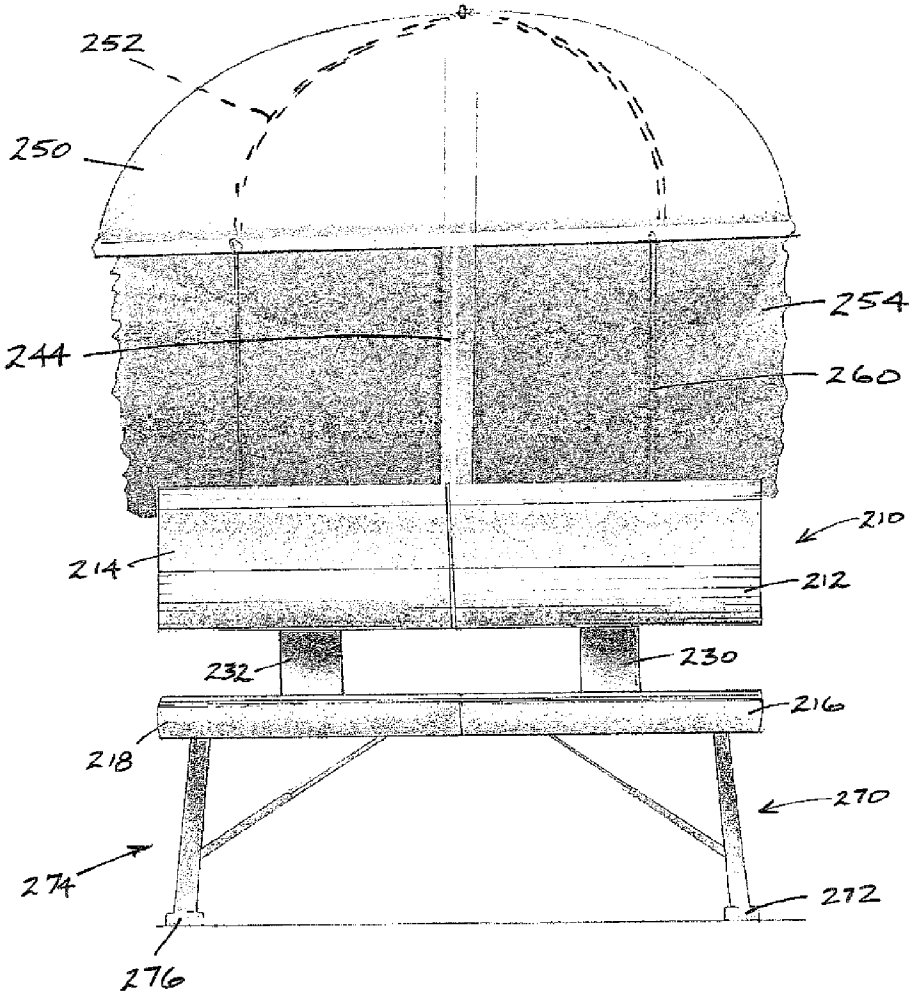
FIG. 8 is a front view of the portable bench of FIG. 7 and a canopy for use with the bench.
Figure 7:
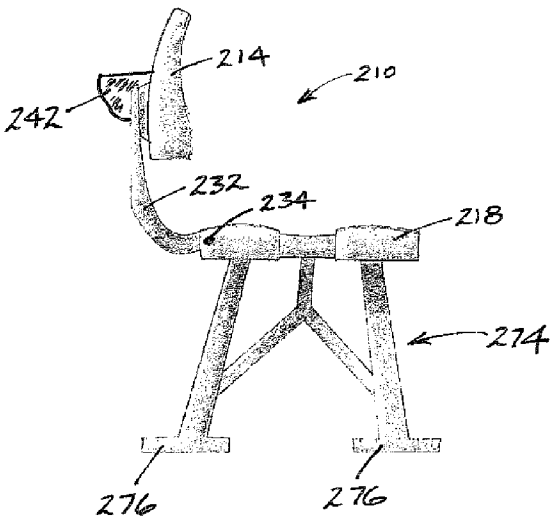
FIG. 7 is a side view of another embodiment of a portable bench having a canopy holder.

Another embodiment of a bench 210 is depicted in FIGS. 7-8. As seen in FIG. 7, a first back rest 212 hingedly attaches to a first seat member 216 via a first support 230 and a hinge pin (not visible) A second back rest 214 hingedly attaches to a second seat member 218 via a second support 232 via a hinge pin 234 (FIG. 7). In the embodiment depicted in FIGS. 7 and 8, two back rests attach to two seat members; however, a fewer or greater number of back rests can attach to a fewer or greater number of seat members. As more clearly seen in FIG. 7, the back rest supports each have a generally curved configuration and are separate components from the respective back rests.

A canopy rod holder 242 extends rearwardly from at least one of the back rests 212 and/or 214. The canopy rod holder 242 includes a cavity (not visible) configured to receive a canopy rod 244 to which a canopy 250 is mounted (only visible in FIG. 8). Alternatively, the rod holder can include a through-bore that is dimensioned to receive the canopy rod and the canopy rod can rest on the ground and/or include a spike or the like that can be inserted into the ground. As seen in the embodiment of FIG. 8, frame work 252 attaches to the rod 244 so that the canopy is expandable similar to a conventional umbrella. A mesh-type backing 254 can attach to a rear side of the canopy to allow a breeze to blow through the mesh-type fabric.

With reference back to FIG. 8, tie downs 260, which can include resilient bands, can be provided to further secure the canopy to the rear of the back rests or back rest supports The canopy holder and canopy described with reference to FIGS. 7 and 8 can be incorporated into the bench 10 depicted in FIGS. 1-6.

A first leg assembly 270 pivotally attaches to the first seat member 216. The first leg assembly can fold up into the first seat member. The first leg assembly can include foot pads 272. Similarly, a second leg assembly 274, which also includes foot pads 276, pivotally attaches to the second seat member 218.

Figure 9:
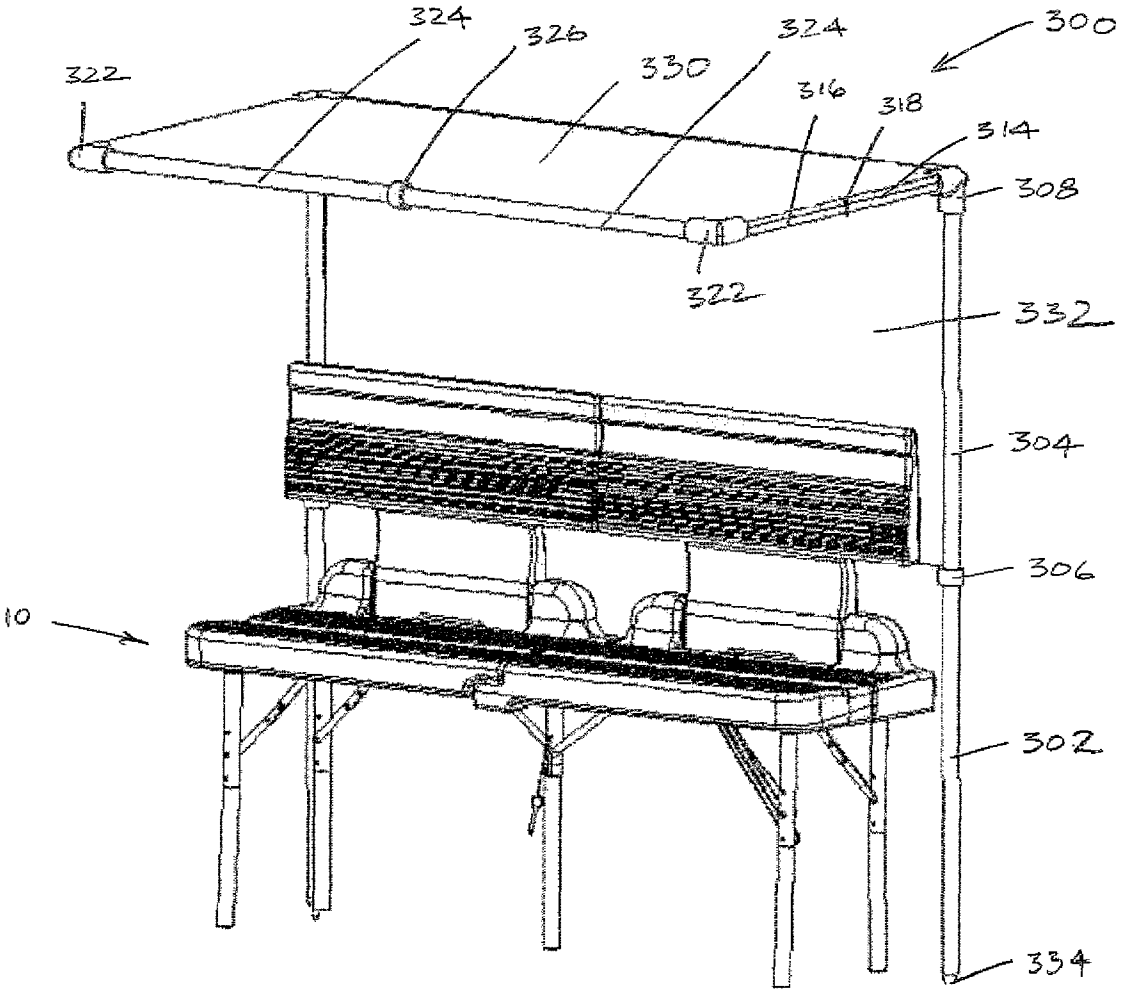
FIG. 9 is a perspective view of the portable sports bench of FIG. 1 and an alternative embodiment of a canopy for use with the bench.
Figure 10:
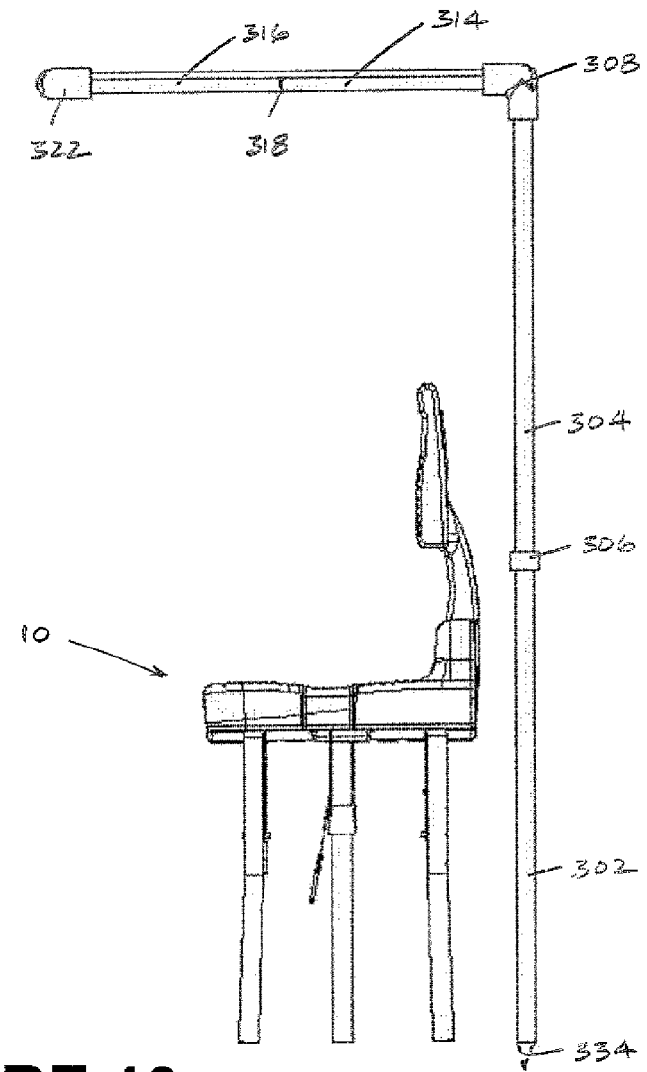
FIG. 10 is a side view of the bench and canopy shown in FIG. 9.
Figure 11:
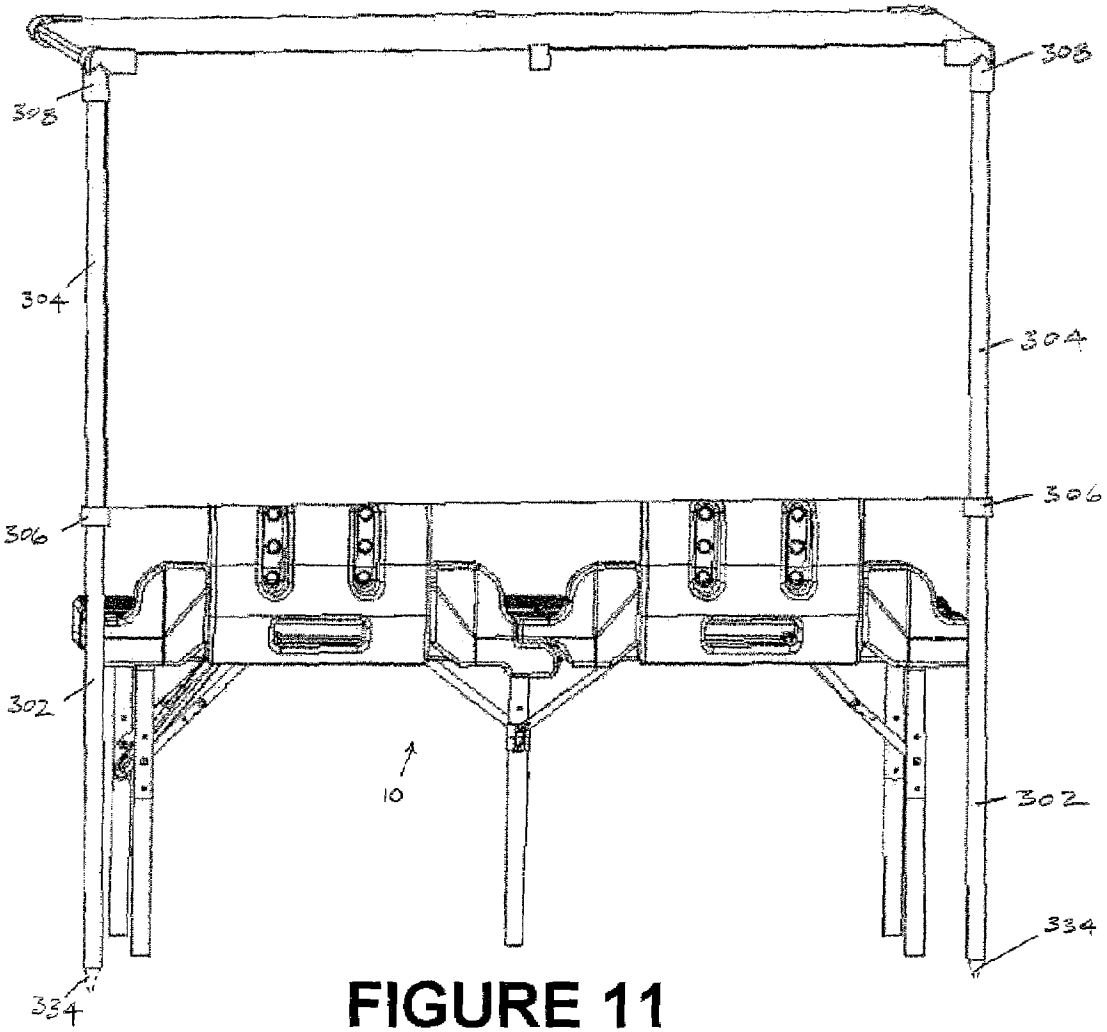
FIG. 11 is a rear view of the bench and canopy shown in FIG. 9.

With reference to FIG. 9, an alternative embodiment of a canopy 300 that can be used with the portable bench 10 is shown. The canopy 300 generally includes a flexible cover and a frame assembly, which are both able to be folded up or knocked down into a convenient package that can be easily stored and carried.

Figure 12:
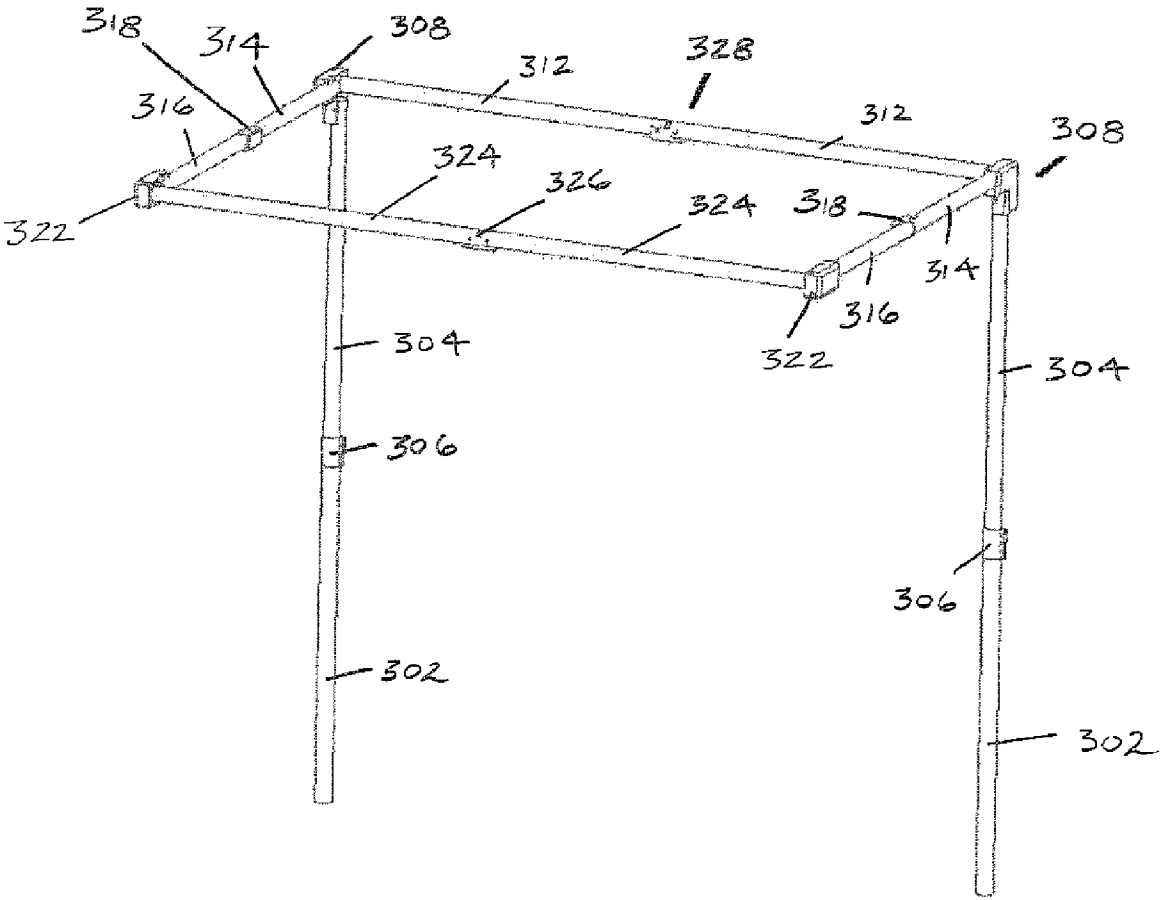
FIG. 12 is a perspective view of a frame assembly of the canopy shown in FIG. 9.

With reference to FIG. 12, the frame assembly includes lower vertical members 302 that attach to upper vertical members 304 via a rotatable lock 306. In the depicted embodiment, the lower vertical members 302 are smaller in diameter than the upper vertical members 304 so that the lower vertical members 302 can fit inside the upper vertical members 304. Such a connection provides for a telescoping arrangement which allows the lower vertical members 302 to be stored inside the upper vertical members 304, and also provides for a height adjustment of the canopy 300. If desired, the upper vertical members 304 can be smaller in diameter than the lower vertical members 302 so that the upper vertical members 304 can fit inside the lower vertical members 302. The rotatable lock 306 fixes the location of the lower vertical member 302 with respect to the upper vertical member 304.

Corner members 308 attach to the upper ends of each upper vertical member 304. With continued reference to FIG. 12, rear horizontal support members 312 attach to the corner members 308 and extend from the upper vertical member 304 at a right angle. First side support members 314 also attach to the corner members 308 and extend from the upper vertical member 304 at a right angle. The first side support members 314 are also disposed at a right angle to the respective rear horizontal support member 312. Second side support members 316 connect to the first side support members 314 at a hinge 318 and extend coaxial therewith. Corner hinges 322 attach to an end of the second side support members 316 that is not connected with the hinges 318. Forward horizontal support members 324 connect to the corner hinges 322 and extend at a right angle to the second side support members 316. A hinge 326 connects the forward horizontal support members 324. A similar hinge 328 connects the rear horizontal support members 312.

With reference back to FIG. 9, the flexible cover includes an upper generally horizontal portion 330 and a rear generally vertical portion 332. The flexible cover can be made from a flexible material such as nylon, cloth, or other durable fabric-like material. The upper portion 330 attaches to the rear horizontal support members 312 (FIG. 12), the forward horizontal support members 324, and the side support members 314 and 316. The rear portion 332 attaches to the upper vertical members 304 and to the rear horizontal support members 312.

Spikes 334 can be provided at the lower end of the lower vertical support member 302 to facilitate insertion into the ground. The canopy can be folded up by loosening the rotatable lock 306 so that the lower vertical members 302 are received inside the upper vertical members 304. The vertical members 302 and 304 can then be pivoted about the corner hinge 308 towards the horizontal support members. The forward horizontal support members 324 and the rear horizontal support members 312 are folded at hinges 326 and 328, respectively. Also, the first side support members 314 are folded toward the second side support members 316 at hinges 318. The canopy 300 can be stored inside the space 66 (FIG. 4) that is formed when the bench 10 is folded.

The benches that have been described above can be neatly folded or knocked down so that the bench can be easily stored and carried. In at least one embodiment, legs fit into respective seat members flush with an underside of the seat member and are concealed when the bench is in the storage position. Accordingly, a compact easily stored unit is provided A portable bench has been described with reference to particular embodiments. Modifications and alterations will occur to those upon reading and understanding the preceding detailed description. Furthermore, aspects from one embodiment can be combined or substituted for aspects of another embodiment. The invention is not limited to only those embodiments as they have been described Instead, the invention is broadly defined by the appended claims and the equivalents thereof.

What is claimed is:

1. A portable bench comprising:

a first seat member;

a first back rest member attached to the first seat member such that at least one of the first seat member and the first back rest member pivots about a first axis;

a second seat member attached to the first seat member such that at least one of the first seat member and the second seat member pivots about a second axis that is at least substantially perpendicular to the first axis;

a second back rest member attached to the second seat member such that at least one of the second seat member and the second back rest member pivots about a third axis that is at least substantially parallel to the first axis;

a first leg attached to the first seat member such that the first leg pivots about a fourth axis that is at least substantially parallel to the second axis;

a second leg attached to the second seat member such that the second leg pivots about a fifth axis that is at least substantially parallel to the second axis; and a third leg attached to at least one of the first seat member and the second seat member;

wherein the first seat member folds towards the second seat member about a portion of the third leg, which is coincident with the second axis, to conceal the legs.

2. The bench of claim 1, wherein the third leg comprises a portion of a hinge connecting the first seat member to the second seat member.

3. The bench of claim 1, wherein the first seat member includes an integrally formed first recess and the second seat member includes an integrally formed second recess, the first recess being configured to receive the first leg when the first leg is pivoted toward the first seat member and the second recess being configured to receive the second leg when the second leg is pivoted toward the second seat member.

4. The bench of claim 1, wherein at least one of the first back rest member and the second back rest member includes an integrally formed handle portion.

5. The bench of claim 1, wherein the first back rest member includes a contoured surface and the first seat member includes a contoured surface, wherein the first back rest member folds toward the first seat member and the contoured surfaces interfit.

6. The bench of claim 5, wherein the second back rest member folds toward the second seat member.

7. The bench of claim 1, wherein the first seat member includes a keyed recess and the second seat member includes a keyed extension, wherein the keyed recess receives the keyed extension when in a use position ready to accommodate a person.

8. The bench of claim 1, wherein the first seat member includes a pair of integrally formed sections that extend toward the first back rest member and the first back rest member connects to the pair of integrally formed sections without using additional fasteners.

9. The bench of claim 8, wherein a lowermost edge of the first back rest member is spaced from a front surface of the pair of integrally formed sections when the first back rest member is pivoted towards the first seat member.

10. A portable bench comprising:

a first seat member;

a first back rest member attached to the first seat member such that at least one of the first seat member and the first back rest member pivots about a first axis;

a second seat member attached to the first seat member such that at least one of the first seat member and the second seat member pivots about a second axis that is at least substantially perpendicular to the first axis;

a second back rest member attached to the second seat member such that at least one of the second seat member and the second back rest member pivots about a third axis that is at least substantially parallel to the first axis;

a first leg attached to the first seat member such that the first leg pivots about a fourth axis that is at least substantially parallel to the second axis;

a second leg attached to the second seat member such that the second leg pivots about a fifth axis that is at least substantially parallel to the second axis; and a T-shaped member, wherein the first seat member and the second seat member each include an integrally formed tab that receives a portion of the T-shaped member, wherein the first seat member and the second seat member rotate about the portion of the T-shaped member received in the integrally formed tabs.

11. The bench of claim 10, wherein the extension has a rounded end surface and the recess includes a rounded surface that complements the rounded end surface.

12. The bench of claim 10, wherein the first leg and the second leg are U-shaped, each having vertical portions, when in a use position, and a central portion of each leg snaps into a recess formed in a respective seat member.

13. The bench of claim 12, wherein the T-shaped member includes a support member that is attached with the portion of the T-shaped member received in the integrally formed tabs, the support member being vertically oriented when the bench is in a use position and being generally centrally located between the vertical portions of the legs with respect to the second axis.

14. The bench of claim 10, wherein the T-shaped member provides a support leg for the bench.

15. The bench of claim 14, wherein the second axis runs through the portion of the T-shaped member received in the integrally formed tabs.

* * * * *